US011753756B2

(12) United States Patent
Silva

(10) Patent No.: US 11,753,756 B2
(45) Date of Patent: Sep. 12, 2023

(54) HEM SEWING SYSTEM

(71) Applicant: Adelite Silva, Boca Raton, FL (US)

(72) Inventor: Adelite Silva, Boca Raton, FL (US)

( * ) Notice: Subject to any disclaimer, the term of this patent is extended or adjusted under 35 U.S.C. 154(b) by 113 days.

(21) Appl. No.: 16/749,654

(22) Filed: Jan. 22, 2020

(65) Prior Publication Data

US 2020/0157721 A1 May 21, 2020

(51) Int. Cl.
*D05B 35/02* (2006.01)

(52) U.S. Cl.
CPC ..... *D05B 35/02* (2013.01); *D05D 2305/04* (2013.01)

(58) Field of Classification Search
CPC .... D05B 35/02; D05B 35/04; D05D 2305/02; D05D 2305/04; D05D 2305/06
See application file for complete search history.

(56) References Cited

U.S. PATENT DOCUMENTS 193,873 A * 8/1877 Ioor ..... D05B 35/02 112/143
2,518,340 A * 8/1950 Levine ..... D05B 35/02 112/141
5,441,002 A * 8/1995 Satoma ..... D05B 35/02 112/143

* cited by examiner

*Primary Examiner* — Nathan E Durham
(74) *Attorney, Agent, or Firm* — Diana Mederos; Mederos Legal, PLLC

(57) ABSTRACT

A dual plate mount system with adjustment brackets, a hook, and fabric spaces is used to improve hem sewing speed and consistency. The target fabric is threaded around and through the hook end and loop, the apparatus adjusting to the desired width and overhang. The apparatus can be used in connection with a sewing machine or manually. The apparatus aligns the fabric hem that is pushed or pulled through toward the sewing machine needle plate.

4 Claims, 5 Drawing Sheets

HEM SEWING SYSTEM

FIELD OF THE DISCLOSURE

The present disclosure relates to methods and apparatuses for a hem sewing system. More specifically, the present disclosure presents a plate configuration to be used in connection with fabric and a sewing apparatus for aligning and sewing a hem with a seam.

BACKGROUND OF THE DISCLOSURE

Sewing machines are traditionally used in the alterations, upholstery, fashion, and home decorating industries. In bespoke industries, fabric is cut and sewn manually and sometimes with the aid of a sewing machine.

Two of the main problems have been speed and constancy with sewing hems for large swaths of fabric. For examples, custom curtains require several yards of fabric. In high-end applications, the hems need to be even, straight, and consistent. However, human error naturally reduces the precision and speed at which hems can be sewn.

Even in the fast-fashion clothing industry, shirts are commonly sewn with uneven hems, giving the shirt an asymmetrical look after being washed. The hem stitching is also uneven for clothing, linens, curtains, sheets, and upholstery.

There presently are no portable, adjustable hem sewing alignment apparatuses that effectively hold the fabric overhang in place for the hem and allow for streamlined hemming in connection with a variety of sewing machines.

SUMMARY OF THE DISCLOSURE

What is needed is the hem sewing system according to the disclosure. The hem sewing system comprises an apparatus having a top plate, a bottom plate, a center, a hook, a hook end, and a hook loop. The top plate and the bottom plate have curved ends. The plates are adjustable, sliding laterally, over or away from the center. The bottom plate as a left adjustment bracket and a right adjustment bracket. Fasteners are supported with a regulator to help hold the plates and fabric in place. The apparatus is portable and can be used in connection with a variety of fabrics and in connection with manual sewing or with any sewing machine.

In another embodiment, the apparatus has a top plate with a hook end and a hook loop and a bottom plate with a curved end. This embodiment does not have adjustment brackets or fasteners. The top plate slides over the bottom plate. The top plate curved end and the bottom plate curved end fit complementary to each other.

Fabric is folded with the edge overlapping the fabric to create a fabric overhang. The fabric overhang is looped through the bottom plate curved end. The hook loop and hook end hold the fabric where the fabric is folded. The fabric lays over the bottom plate. The top plate can be moved laterally toward or away from the center depending on the size of the overhang.

The user grabs the fabric at the overhang that lays over the bottom plate and pulls the fabric away from the apparatus and toward a sewing machine. The apparatus loaded with the fabric is placed on one side of the sewing machine. The user holds the apparatus toward a solid surface such as a table. The user can press on the apparatus edges or use weights or clamps to keep the apparatus in place. The user pulls the fabric overhang toward the sewing machine needle to start the hem. The user pulls the hemmed fabric overhang from the other side of the sewing machine, so the fabric overhang is pulled parallel to the sewing machine and under the needle which threads the hem or seam over the needle plate.

The resulting hem has a substantially consistent seam and overhang. The resulting hem is completed in approximately 10-60 percent of the time it would take to traditionally sew a hem.

BRIEF DESCRIPTION OF THE DRAWINGS

The accompanying drawings, that are incorporated in and constitute a part of this specification, illustrate several embodiments of the disclosure and, together with the description, serve to explain the principles of the disclosure.

Figure 1:
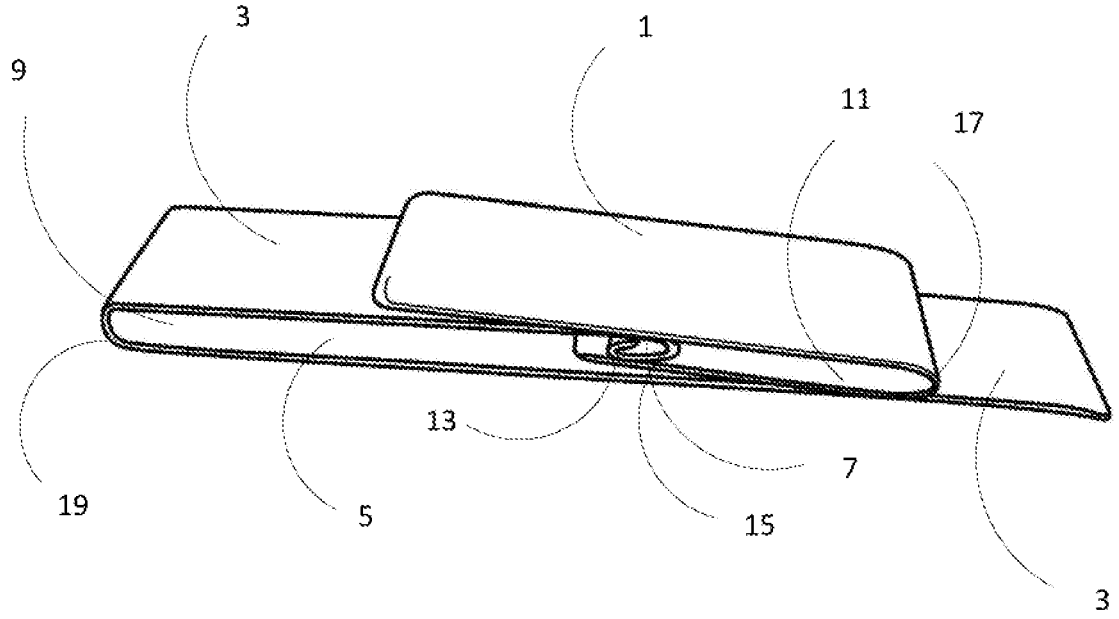
FIG. 1 shows a perspective view of an exemplary embodiment of a hem sewing system.

The following are the numbers represented in the Figures.

1. top plate
3. bottom plate
5. Center
7. Hook
9. Left fabric space
11. Right fabric space
13. Hook end
15. Hook loop
17. Top plate curved end
19. Bottom plate curved end
21. Fastener
22. Regulator
23. Top plate adjustment bracket
25. Bottom plate left adjustment bracket
27. Bottom plate right adjustment bracket
29. Fabric
31. Fabric edge
33. Fabric overhang
35. Sewing apparatus
37. Needle
39. Thread
41. Needle plate

DETAILED DESCRIPTION

The present disclosure provides generally for a hem sewing system herein referred to as "system." According to the present disclosure, a system generally comprises at least two plates capable of being overlapped and slid above and below fabric. Fabric is sandwiched between the at least two plates. At least one plate comprises a hook about which a folded fabric edge is wound through. A second or subsequent piece of fabric may be aligned with or sandwiched between the plates with a first piece of fabric to create a busted seam stitch. The fabric edge and overhang lies flat against a surface such as a table or a sewing machine needle plate. The plates may be adjusted inward toward a center or outward from a center to accommodate a variety of desired hem and overhang lengths. A sewing apparatus needle is placed where a seam will be sewn. The sewing apparatus such as a motorized sewing machine and the system remain in place. A person or a separate machine pulls the looped fabric sandwiched between the plates through the plates toward the sewing apparatus needle. A scam or hem is quickly and evenly sewn in a substantially straight line.

Generally, a system is used in connection with fabric and a sewing apparatus such as a powered or manual sewing machine or a sewing needle and thread used by hand. Fabrics include any textile that is capable of being sewn with a needle and thread. Fabrics that may be used comprise sheets of fabrics made of natural, synthetic, or a combination thereof of yarns or materials. Examples of materials include cotton, flax, polyester, nylon, elastane, spandex, silk, linen, jacquard, bamboo, lame, leather, fur, tapestry, twill, velour, sherpa, lace, oxford, broadcloth, denim, jersey, and fleece. Other examples of fabric types include muslin, organza, terry, velvet, tweed, taffeta, sateen, corduroy, woven blends, and knits such as ponte, rib, interlock, and eyelet. The fabric may be used in conjunction with a zipper tape, lining, or trim.

The discreet profile, size, and adjustability of the system makes it versatile for seamstresses, tailors, and for those working in the following industries and applications: fast fashion and high fashion clothing, shoes, and accessories; upholstery; window treatments; bathroom linens; bedroom linens; floor coverings and rugs; performing arts sets and costumes.

The system allows freedom and customizability in creating a seam and hem that works best for the application. For example, a system will not obstruct or hinder a seamstress for sewing seams such as an overlock stitch where the fabric raw edges are connected with interlocking stitches without any extra folds with excess material for the hem. A busted seam can be made with the system apparatus as well.

In the following sections, detailed descriptions of examples and methods of the disclosure will be given. The description of both preferred and alternative examples are exemplary only, and it is understood that to those skilled in the art that variations, modifications, and alterations may be apparent. It is therefore to be understood that the examples do not limit the broadness of the aspects of the underlying disclosure as defined by the claims.

Referring now to FIG. 1, an exemplary embodiment of a plate is shown. In this exemplary embodiment, a system apparatus comprises a top plate coordinated with a bottom plate, a left fabric space, a bottom plate curved end, a center, a hook end, a hook loop, a hook, a right fabric space, a top plate curved end, and a bottom plate. The bottom plate and the top plate may have widths, lengths, and heights that are substantially similar or may vary. For example, widths may be from approximately 2 cm to 20 cm, heights from approximately 0.1 cm to 1 cm, and lengths from approximately 9 cm to 40 cm. The various possible dimensions will depend on the type of fabric and how large or small the fabric overhang is.

In preferred embodiments, the apparatus is sized to fit comfortably in a sewing kit, apron pocket, or tote bag. The apparatus is intended to be portable. However, it is also anticipated some systems may include a sewing machine on a solid surface where the apparatus is integrated in with the solid surface with fasteners or adhesives or where the apparatus is integrated into the sewing machine structure.

The top and bottom plate curved ends are positioned opposite each other about the center. The hook with hook end and hook loop is preferably positioned at or substantially near the center of the apparatus. A user pulls the top plate and bottom plate curved ends away from the center to accommodate larger fabric overhands. The fabric is folded to create an overhang, and a seam is typically sewn at or within a few centimeters from the fold. The overhang is laid over the bottom plate and within the left fabric space and the right fabric space. The fold is held in place and aligned by threading the folded overhang over and through the hook loop and held by the hook end.

Figure 2A:
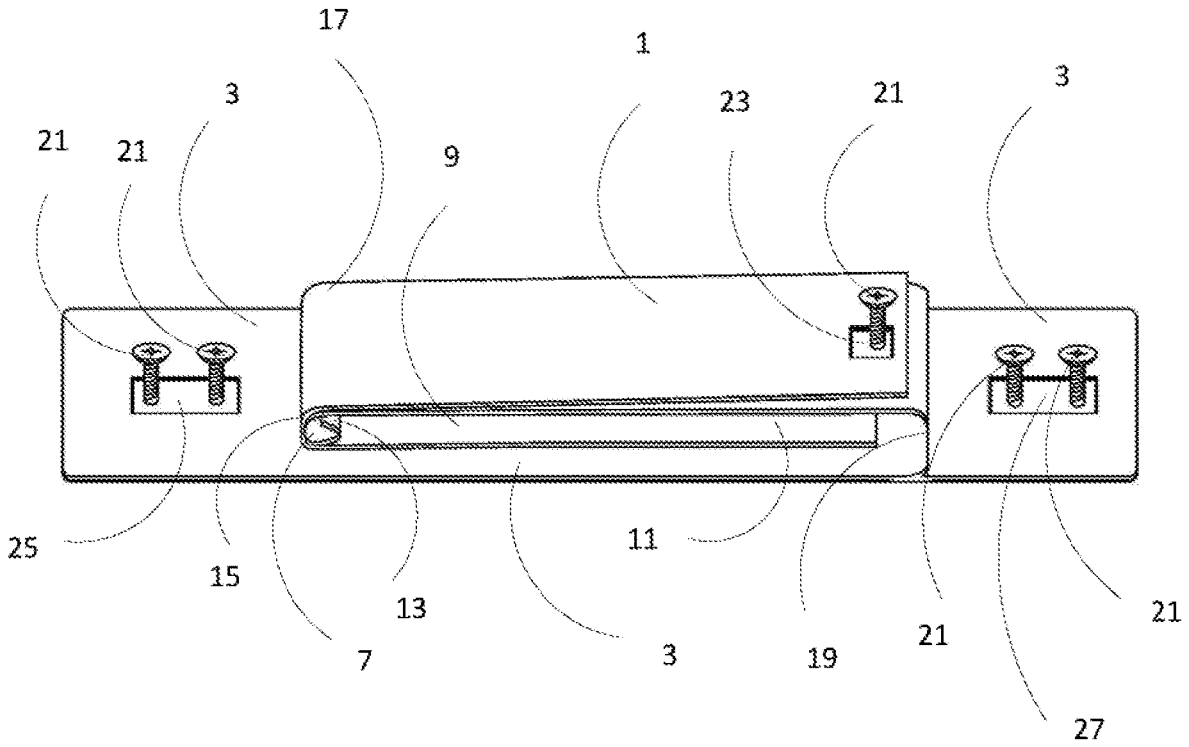
FIG. 2A shows a top perspective view of an exemplary embodiment of a hem sewing system with regulation fasteners.

Referring now to FIG. 2A, a top perspective view of an exemplary embodiment of a hem sewing system with regulation fasteners is shown. In some embodiments, the system apparatus comprises a plurality of fasteners, a bottom plate left adjustment bracket, a bottom plate, a top plate curved end, a hook, a hook end, a bottom plate, a right fabric space, a bottom plate curved end, a bottom plate right adjustment bracket, a top plate adjustment bracket, a top plate, and a left fabric space.

Similar to the embodiment of FIG. 1, the folded fabric lays over the bottom plate and the center between the top plate curved end and the bottom plate curved end. However, this exemplary embodiment has the addition of adjustment brackets with one bracket on the top plate and two brackets on the bottom plate. The brackets are couple with at least one fastener each. The brackets and fasteners provide a more rigid structure to the apparatus to improve holding the fabric in place. The fasteners may be adjusted. In some embodiments, fasteners on the bottom plate may be used to removably attach the apparatus to a solid surface such as a tabletop. The plates can be adjusted by pulling them away from the center or pushing them toward the center to accommodate various fabric overhang widths.

Figure 2B:
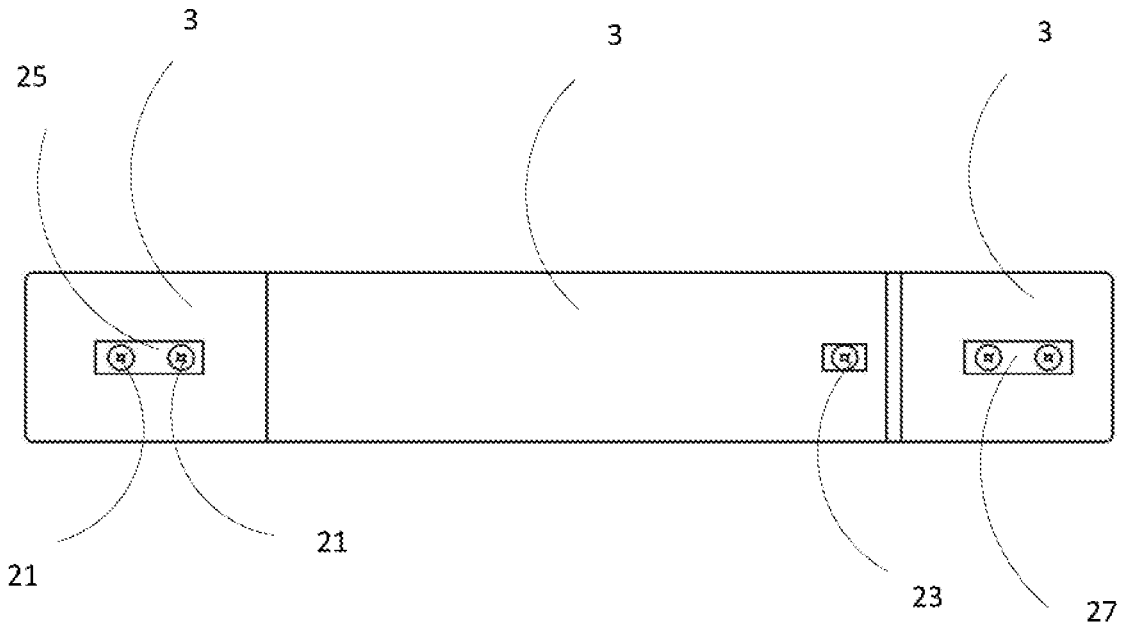
FIG. 2B shows a bottom perspective view of an exemplary embodiment of a hem sewing system with adjustable fasteners.

Referring now to FIG. 2B, a bottom perspective view of an exemplary embodiment of a hem sewing system with adjustable fasteners is shown. The apparatus bottom plate shows the bottom view of the bottom plate left adjustment bracket, the bottom plate right adjustment bracket, and the top plate adjustment bracket with the corresponding fasteners. The fastener from the top plate adjustment bracket is threaded through the regulator shown in FIG. 2C and to the bottom plate to aid with alignment of the top plate over the bottom plate.

Figure 2C:
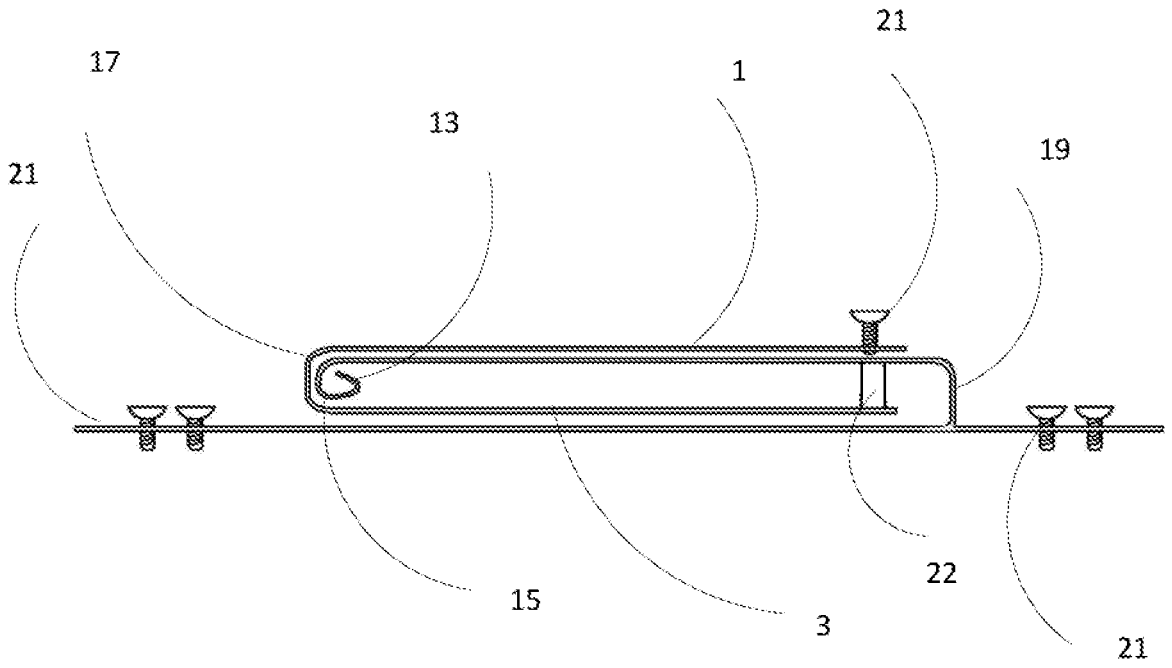
FIG. 2C shows a side view of an exemplary embodiment of a hem sewing system with regulation fasteners.

Referring now to FIG. 2C, a side view of an exemplary embodiment of a hem sewing system with regulation fasteners is shown. This exemplary embodiment shows the adjustment brackets with fasteners. The center with left and right fabric spaces is more visible and shows the hook with the hook loop and hook end from the bottom plate. The fabric may be loaded and threaded around and through the loop to create a fold or crease before or after placing the top plate in position. The top plate may be held in place by threading a fastener through the top plate adjustment bracket that contains an aperture and a regulator. The regulator may extend to the bottom curve of the top plate or may extend only to the top of the curved end of the bottom plate.

Figure 3:
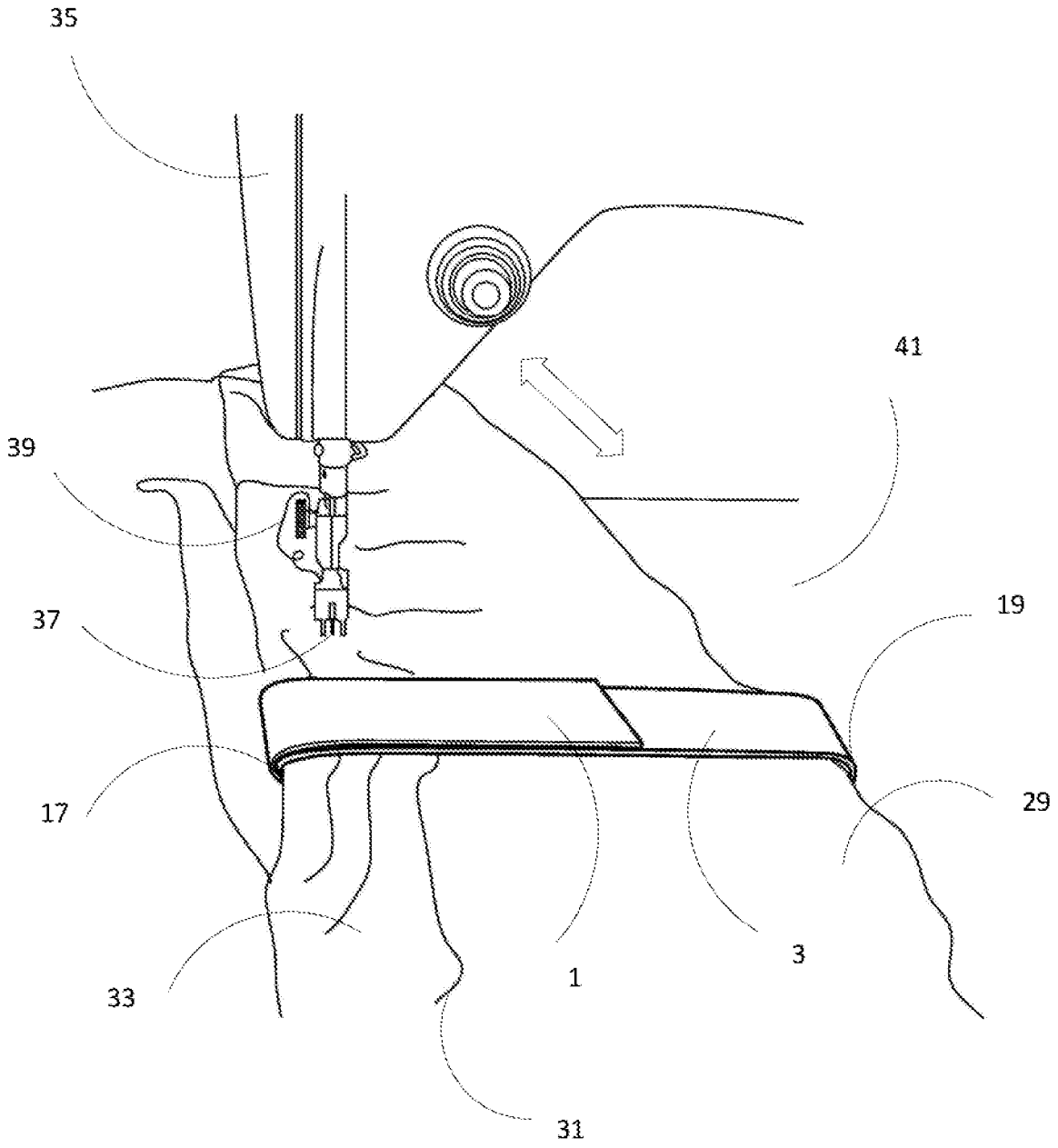
FIG. 3 shows a front perspective view of an exemplary embodiment of a hem sewing system in use.

Referring now to FIG. 3, a front perspective view of an exemplary embodiment of a hem sewing system in use. A piece of fabric, typically long yards of fabric are folded to create an overhang with a fabric edge. A seam is sewn between the fold and the edge of the overhang. In this exemplary embodiment, the portable system apparatus is threaded with the folded fabric and through the hook loop and held in place at the hook end. The apparatus is placed on one side of a sewing apparatus having a needle and threat and a needle plate.

The folded fabric overhang is pulled through the apparatus center toward the needle plate to start the hem. The hemmed fabric is pulled parallel to the front of the sewing machine, through the apparatus center and left and right fabric spaces, over the needle plate and under the needle, and to the other side of the sewing machine.

The end result is a substantially uniform and consistent seam and hem with fabric overhang. During product testing, the length of hem sewn decreased from approximately 20 to 60 percent of the time it would take if the same seam were sewn without the system apparatus.

Thus, particular embodiments of the subject matter have been described. Other embodiments are within the scope of the following claims. In some cases, the actions recited in the claims can be performed in a different order and still achieve desirable results. Nevertheless, it will be understood that various modifications may be made without departing from the spirit and scope of the claimed disclosure.

What is claimed is:

1. A method of implementing a dual-plate apparatus comprising a top plate removably coupled to a corresponding bottom plate, wherein the bottom plate has a curved end, and the top plate has a curved end that cradles the bottom plate curved end, and wherein the bottom plate has a hook with a hook loop and a hook end, and wherein the top plate and the bottom plate are substantially similar in width, and wherein the bottom plate comprises a right adjustment bracket having a rectangle shape and having two fasteners arranged horizontally in the right adjustment bracket and a left adjustment bracket having a rectangle shape and having two fasteners arranged horizontally in the left adjustment bracket, the method steps comprising a. selecting fabric;

b. threading the fabric through the hook of the bottom plate and around the hook loop to create a fold with a fabric overhang having a fabric edge;

c. placing the top plate over the bottom plate by inserting the bottom plate curved end into a center space of a top plate open end to where the top plate curved end cradles the hook;

d. pulling the fabric overhang through the center space;

e. placing the apparatus with fabric on one side of a sewing machine having a needle, thread, and needle plate, and where the apparatus is not mounted to the sewing machine;

f. placing the pulled overhang over the needle plate to start sewing a seam; and g. activating the sewing machine to sew a seam.

2. The method steps of claim 1 further comprising pulling the fabric with the sewed seam over the needle plate of the sewing machine and through the other side of the sewing machine in a manner parallel to the front of the sewing machine while the apparatus is not mounted to the sewing machine.

3. The method steps of claim 2 further comprising adjusting the width of the center of the apparatus by pulling the top plate curved end away from the hook.

4. The method steps of claim 3 further comprising securing the top plate to the bottom plate by threading a fastener through an aperture of the top plate wherein the top plate has an adjustment bracket and a regulator.

* * * * *